US005568971A

United States Patent [19]

Jewell

[11] Patent Number: 5,568,971

[45] Date of Patent: Oct. 29, 1996

[54] WRIST MOUNTED LIGHT SOURCE

[76] Inventor: Killairne Jewell, 8420 Cozycroft Ave., Canoga Park, Calif. 91306-1508

[21] Appl. No.: 631,960

[22] Filed: Apr. 15, 1996

[51] Int. Cl.[6] ..... F21L 15/08

[52] U.S. Cl. ..... 362/103; 362/108; 362/184; 362/205

[58] Field of Search ..... 362/103, 184, 362/104, 206, 108, 105, 200, 205, 206, 293, 257, 197

[56] References Cited

U.S. PATENT DOCUMENTS

| | | | |
|---|---|---|---|
| 2,805,326 | 9/1957 | Schwartz | 362/103 |
| 3,321,617 | 5/1967 | Santana | 362/103 |
| 3,944,803 | 3/1976 | Chao | 362/108 |
| 4,417,819 | 11/1983 | Migeon | 368/67 |
| 4,788,631 | 11/1988 | Fuller | 362/103 |
| 4,910,652 | 3/1990 | Rhine | 362/103 |
| 5,193,896 | 3/1993 | Oberlander | 362/103 |

*Primary Examiner*—James C. Yeung

[57] ABSTRACT

A wrist mounted light source including a central housing having a generally cylindrical housing. An upper surface has an opening centrally located therein. A lower surface has an opening therein. A surrounding side wall has a first opening and a second opening therein. A battery is secured within the central housing inwardly of the opening in the lower surface thereof. An upper light is secured within the central housing inwardly of the opening in the upper surface thereof. The upper light is electrically coupled with the battery. A side light is secured within the central housing inwardly of the first opening in the surrounding side wall thereof. The side light is electrically coupled with the battery. A power switch is secured within the second opening of the surrounding side wall of the central housing. The power is electrically coupled with the battery and the top light and the side light.

4 Claims, 3 Drawing Sheets

WRIST MOUNTED LIGHT SOURCE

BACKGROUND OF THE INVENTION

1. Field of the Invention

The present invention relates to a wrist mounted light source and more particularly pertains to wearing a light source on a user's wrist with a wrist mounted light source.

2. Description of the Prior Art

The use of wrist lights is known in the prior art. More specifically, wrist lights heretofore devised and utilized for the purpose of providing exterior illumination are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,417,819 to Migeon discloses a watchband light attachment for a wristwatch.

U.S. Pat. No. 4,910,652 to Rhine discloses a combination wrist watch and flashlight.

U.S. Pat. No. Des. 340,778 to Oberlander discloses the ornamental design for a wrist light.

U.S. Pat. No. Des. 344,411 to Henry et al. discloses the ornamental design for a wrist light mount.

U.S. Pat. No. 4,788,631 to Fuller discloses a wrist mounted flashlight.

U.S. Pat. No. Des. 324,579 to Crabtree, Jr. discloses the ornamental design for a wrist-attached flashlight.

While these devices fulfill their respective, particular objective and requirements, the aforementioned patents do not describe a wrist mounted light source for wearing a light source on a user's wrist.

In this respect, the wrist mounted light source according to the present invention substantially departs from the conventional concepts and designs of the prior art, and in doing so provides an apparatus primarily developed for the purpose of wearing a light source on a user's wrist.

Therefore, it can be appreciated that there exists a continuing need for new and improved wrist mounted light source which can be used for wearing a light source on a user's wrist. In this regard, the present invention substantially fulfills this need.

SUMMARY OF THE INVENTION

In the view of the foregoing disadvantages inherent in the known types of wrist lights now present in the prior art, the present invention provides an improved wrist mounted light source. As such, the general purpose of the present invention, which will be described subsequently in greater detail, is to provide a new and improved wrist mounted light source and method which has all the advantages of the prior art and none of the disadvantages.

To attain this, the present invention essentially comprises a central housing having a generally cylindrical housing. The central housing has a planar upper surface, a planar lower surface, and a surrounding side wall therebetween. The central housing has a hollow interior. The upper surface has an opening centrally located therein. The lower surface has an opening therein. The surrounding side wall has a first opening and a second opening therein with the first opening and the second opening being diametrically opposed. The surrounding side wall has a pair of recesses therein diametrically opposed from one another. Batteries are secured within the hollow interior of the central housing inwardly of the opening in the lower surface thereof. A battery door is removably coupled with the opening in the lower surface. An upper light is secured within the hollow interior of the central housing inwardly of the opening in the upper surface thereof. The upper light is electrically coupled with the batteries. The upper light has a door slidably coupled within the opening in the upper surface of the central housing. A side light is secured within the hollow interior of the central housing inwardly of the first opening in the surrounding side wall thereof. The side light is electrically coupled with the battery. The side light has a door slidably coupled within the first opening in the surrounding side wall of the central housing. A power switch is secured within the second opening of the surrounding side wall of the central housing. The power switch is electrically coupled with the a three way circuit to the batteries and the top light and the side light. The device includes a securement strap having a first segment and a second segment. The first segment and the second segment have end portions secured within the opposed recesses in the surrounding side wall of the central housing. The first segment has a loop secured to an opposing end portion thereof. The second segment has male and female pile type fasteners disposed thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved wrist mounted light source which has all the advantages of the prior art wrist lights and none of the disadvantages.

It is another object of the present invention to provide a new and improved wrist mounted light source which may be easily and efficiently manufactured and marketed.

it is a further object of the present invention to provide a new and improved wrist mounted light source which is of durable and reliable construction.

An even further object of the present invention is to provide a new and improved wrist mounted light source which is susceptible of a low cost of manufacture with regard to both materials and labor, and which accordingly is then susceptible of low prices of sale to the consuming public, thereby making such a wrist mounted light source economically available to the buying public.

still yet another object of the present invention is to provide a new and improved wrist mounted light source which provides in the apparatuses and methods of the prior art some of the advantages thereof, while simultaneously overcoming some of the disadvantages normally associated therewith.

Even still another object of the present invention is to provide a new and improved wrist mounted light source for wearing a light source on a user's wrist.

Lastly, it is an object of the present invention to provide a new and improved wrist mounted light source including a central housing having a generally cylindrical housing. The central housing has a hollow interior. An upper surface has an opening centrally located therein. A lower surface has an opening therein. A surrounding side wall has a first opening and a second opening therein with the first opening and the second opening being diametrically opposed. The central housing has means for securement to a wrist of a user. Batteries are secured within the hollow interior of the central housing inwardly of the opening in the lower surface thereof. An upper light is secured within the hollow interior of the central housing inwardly of the opening in the upper surface thereof. The upper light is electrically coupled with the battery. A side light is secured within the hollow interior of the central housing inwardly of the first opening in the surrounding side wall thereof. The side light is electrically coupled with the circuit and the batteries. A power switch is secured within the second opening of the surrounding side wall of the central housing. The power is electrically coupled with the circuit and the batteries and the top light and the side light.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
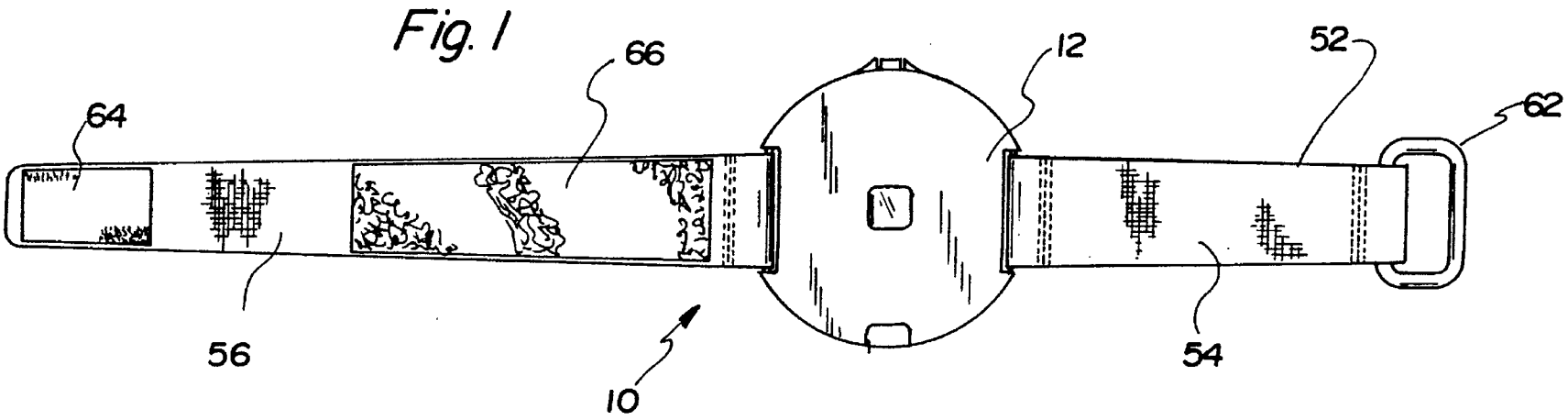
FIG. 1 is a perspective view of the preferred embodiment of the wrist mounted light source constructed in accordance with the principles of the present invention.
Figure 2:
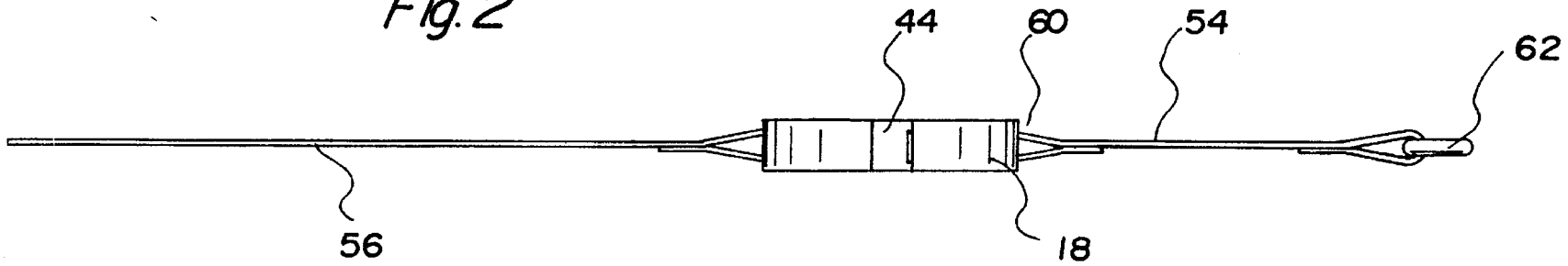
FIG. 2 is a side elevation view of the present invention.
Figure 4:
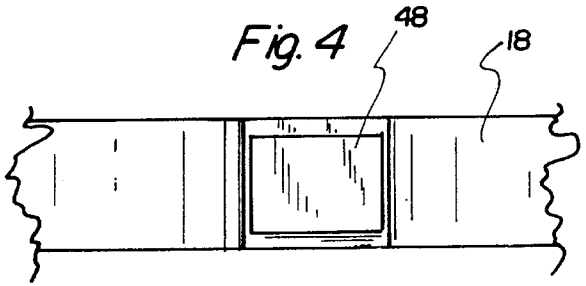
FIG. 4 is a side view of the power switch of the present invention.
Figure 3:
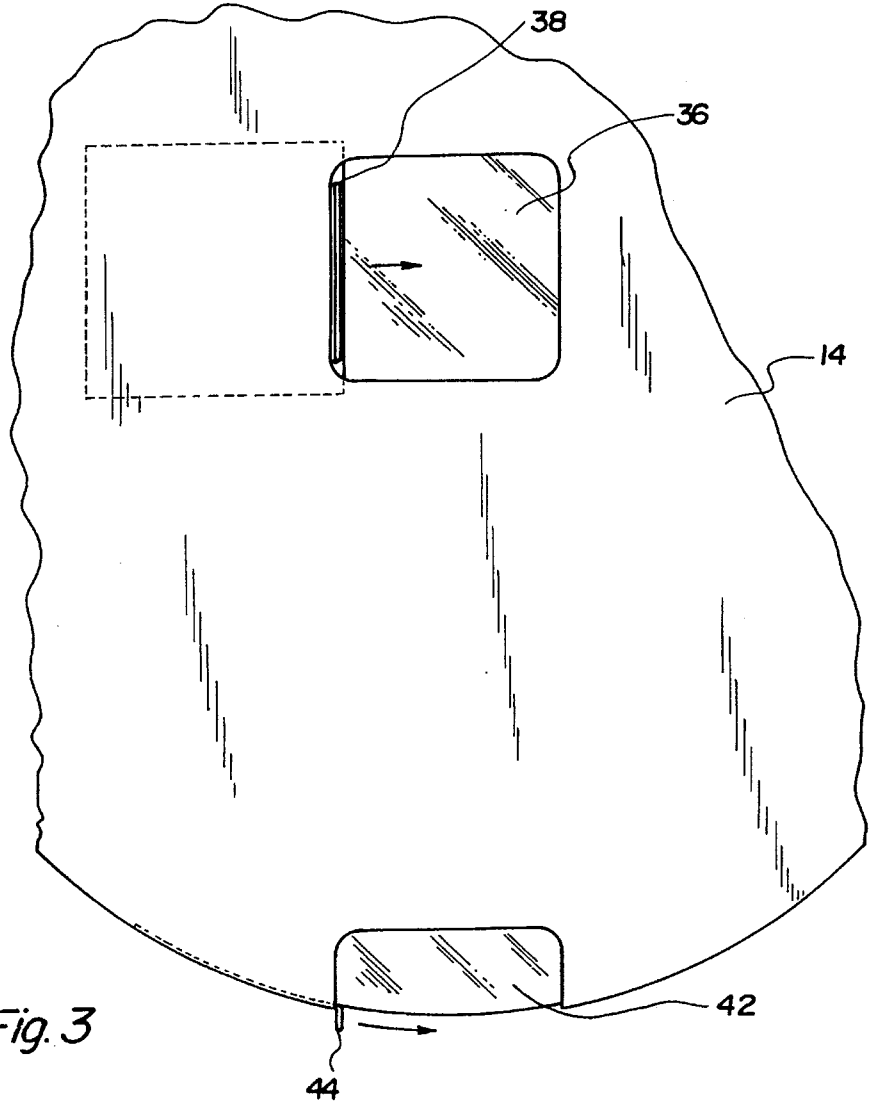
FIG. 3 is an enlarged plan view of the present invention.
Figure 5:
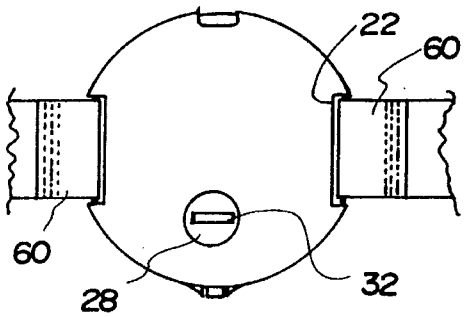
FIG. 5 is a bottom view of the central housing of the present invention.
Figure 6:
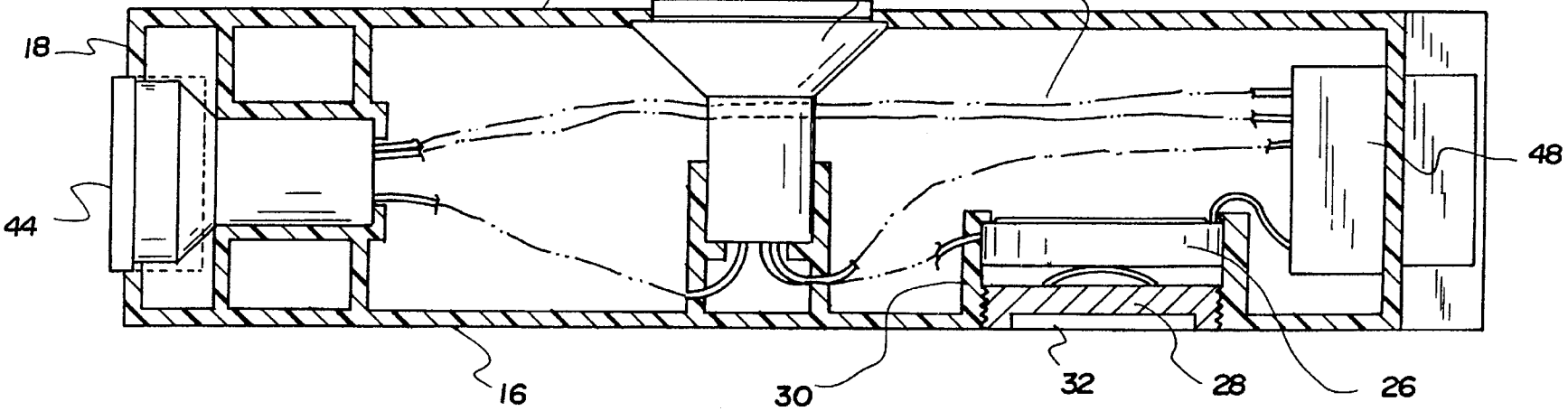
FIG. 6 is a cross-sectional side view of the central housing of the present invention.

With reference now to the drawings, and in particular, to FIGS. 1–6 thereof, the preferred embodiment of the new and improved wrist mounted light source embodying the principles and concepts of the present invention and generally designated by the reference number 10 will be described.

Specifically, it will be noted in the various Figures that the device relates to a new and improved wrist mounted light source for wearing a light source on a user's wrist. In its broadest context, the device consists of a central housing, a set of batteries, an upper light, a side light, a power switch and a securement strap. Such components are individually configured and correlated with respect to each other so as to attain the desired objective.

The device 10 includes a central housing 12 having a generally cylindrical configuration. The central housing 12 resembles a typical wristwatch. The central housing 12 has a planar upper surface 14, a planar lower surface 16, and a surrounding side wall 18 therebetween. The upper surface 14 could also be curved to accommodate a convex lens. The planar upper surface 14 and the planar lower surface 16 are in parallel relationship to one another. The central housing 12 has a hollow interior 20. The upper surface 14 has an opening centrally located therein. The lower surface 16 has an opening therein. The surrounding side wall 18 has a first opening and a second opening therein with the first opening and the second opening being diametrically opposed. The surrounding side wall 18 has a pair of recesses 22 therein diametrically opposed from one another.

A set of batteries 26 are secured within the hollow interior 20 of the central housing 12 inwardly of the opening in the lower surface 16 thereof. A battery door 28 is removably coupled with the opening in the lower surface 16. The batteries 26 are secured between a pair of securement posts 30 within the hollow interior 20. The batteries 26 used is a standard type used in wristwatches. The battery door 28 has a slot 32 formed therein to allow for the removal of the door 28 in order to change the batteries 26 as needed.

An upper light 36 is secured within the hollow interior 20 of the central housing 12 inwardly of the opening in the upper surface 14 thereof. The upper light 36 is electrically coupled with the circuit to the batteries 26. The upper light 36 has a door 38 slidably coupled within the opening in the upper surface 14 of the central housing 12. The door 38 can slide open to expose the upper light 36 through the opening in the upper surface 14. The upper light 36, when illuminated, sends a beam of light perpendicular to the user's wrist.

A side light 42 is secured within the hollow interior 20 of the central housing 12 inwardly of the first opening in the surrounding side wall 18 thereof. The side light 42 is electrically coupled with the battery 26. The side light 42 has a door 44 slidably coupled within the first opening in the surrounding side wall 18 of the central housing 12. The door 44 can slide open to acsess the side light 42 through the first opening in the surrounding side wall 18 for replacement thereof. The side light 42, when illuminated, sends a beam of light out parallel with the user's wrist.

A power switch 48 is secured within the second opening of the surrounding side wall 18 of the central housing 12. The power switch 48 is electrically coupled with the circuit to the batteries 26 and the top light 36 and the side light 42. The power switch 48 is a push button that will work as a three way switch having a first setting to activate the top light 36, a second setting to activate the side light 42 and a third setting to deactivate both the top light 36 and the side light 42.

Lastly, the device 10 includes a securement strap 52 having a first segment 54 and a second segment 56. The first segment 54 and the second segment 56 have end portions 60 secured within the opposed recesses 22 in the surrounding side wall 18 of the central housing 12. The first segment 54 has a loop 62 secured to an opposing end portion thereof. The second segment 56 has male 64 and female pile type fasteners 66 disposed thereon. The end portion with the male fastener 64 of the second segment 56 is wrapped around the user's wrist and through the loop 62 to couple with the female fastener 64 for securement around the user's wrist. By exposing either the upper light 36 or the side light 42, the user is able to illuminate different areas without the need to adjust the position of their arm.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A wrist mounted light source for wearing a light source on a user's wrist comprising, in combination:

a central housing having a generally cylindrical configuration, the central housing having a planar upper surface, a planar lower surface, and a surrounding side wall therebetween, the central housing having a hollow interior, the upper surface having an opening centrally located therein, the lower surface having an opening therein, the surrounding side wall having a first opening and a second opening therein with the first opening and the second opening being diametrically opposed, the surrounding side wall having a pair of recesses therein being diametrically opposed;

a pair of batteries secured within the hollow interior of the central housing inwardly of the opening in the lower surface thereof, a battery door removably coupled with the opening in the lower surface;

an upper light secured within the hollow interior of the central housing inwardly of the opening in the upper surface thereof, the upper light being electrically coupled with the a circuit and the batteries, the upper light having a door slidably coupled within the opening in the upper surface of the central housing;

a side light secured within the hollow interior of the central housing inwardly of the first opening in the surrounding side wall thereof, the side light being electrically coupled with the circuit and the batteries, the side light having a door slidably coupled within the first opening in the surrounding side wall of the central housing;

a power switch secured within the second opening of the surrounding side wall of the central housing, the power switch being electrically coupled with a three way switch with the circuit to the batteries and the top light and the side light;

a securement strap having a first segment and a second segment, the first segment and the second segment having end portions secured within the opposed recesses in the surrounding side wall of the central housing, the first segment having a loop secured to an opposing end portion thereof, the second segment having male and female pile type fasteners disposed thereon.

2. A wrist mounted light source comprising:

a central housing having a generally cylindrical configuration, the central housing having a hollow interior, an upper surface having an opening centrally located therein, a lower surface having an opening therein, a surrounding side wall having a first opening and a second opening therein with the first opening and the second opening being diametrically opposed, the central housing having means for securement to a wrist of a user;

batteries secured within the hollow interior of the central housing inwardly of the opening in the lower surface thereof;

an upper light secured within the hollow interior of the central housing inwardly of the opening in the upper surface thereof, the upper light being electrically coupled with a circuit and the batteries;

a side light secured within the hollow interior of the central housing inwardly of the first opening in the surrounding side wall thereof, the side light being electrically coupled with the circuit and the batteries;

a power switch secured within the second opening of the surrounding side wall of the central housing, the power being electrically coupled with a three way switch with the circuit to the batteries and the top light and the side light.

3. The light source as set forth in claim 2 wherein the upper light and the side light each having a sliding door coupled thereto.

4. The light source as set forth in claim 2 wherein the means for securement to a wrist of a user comprising a securement strap having a first segment and a second segment, the first segment and the second segment having end portions secured within the surrounding side wall of the central housing, the first segment having a loop secured to an opposing end portion thereof, the second segment having male and female pile type fasteners disposed thereon.

* * * * *